United States Patent [19]

Sylverst

[11] 4,107,803

[45] Aug. 22, 1978

[54] SEA TERMINAL

[76] Inventor: Leroy M. Sylverst, 910 Riverside Dr., New York, N.Y. 10032

[21] Appl. No.: 828,008

[22] Filed: Aug. 25, 1977

Related U.S. Application Data

[60] Division of Ser. No. 730,109, Oct. 6, 1976, Pat. No. 4,067,080, which is a continuation of Ser. No. 529,651, Dec. 4, 1974, abandoned.

[51] Int. Cl.[2] ..... B63B 21/52

[52] U.S. Cl. ..... 9/8 P; 114/74 T; 114/256

[58] Field of Search ..... 9/8 R, 8 P; 114/74 T, 114/144 B, 230, 256, 257, 258, 264; 137/236; 220/13

[56] References Cited

U.S. PATENT DOCUMENTS 3,178,737 4/1965 Brackx ..... 9/8 P

*Primary Examiner*—Stephen G. Kunin
*Assistant Examiner*—Charles E. Frankfort
*Attorney, Agent, or Firm*—Blum, Moscovitz, Friedman & Kaplan

[57] ABSTRACT

A sea terminal having compartments for storage of fluids and adapted for the transfer of the fluids between the compartments and a ship. The sea terminal is constructed to eliminate the need for swivel hose connections as the ship swings in relation to the terminal. In another embodiment, the sea terminal may be sufficiently large to include drilling apparatus thereby providing a self-contained terminal which can drill into a sea bed, pump sub-sea oil into the compartments in the terminal and transfer the oil to a cargo ship. Alternatively, the sea terminal may be transported to a discharge point for discharging the oil.

7 Claims, 14 Drawing Figures

FIG. 6
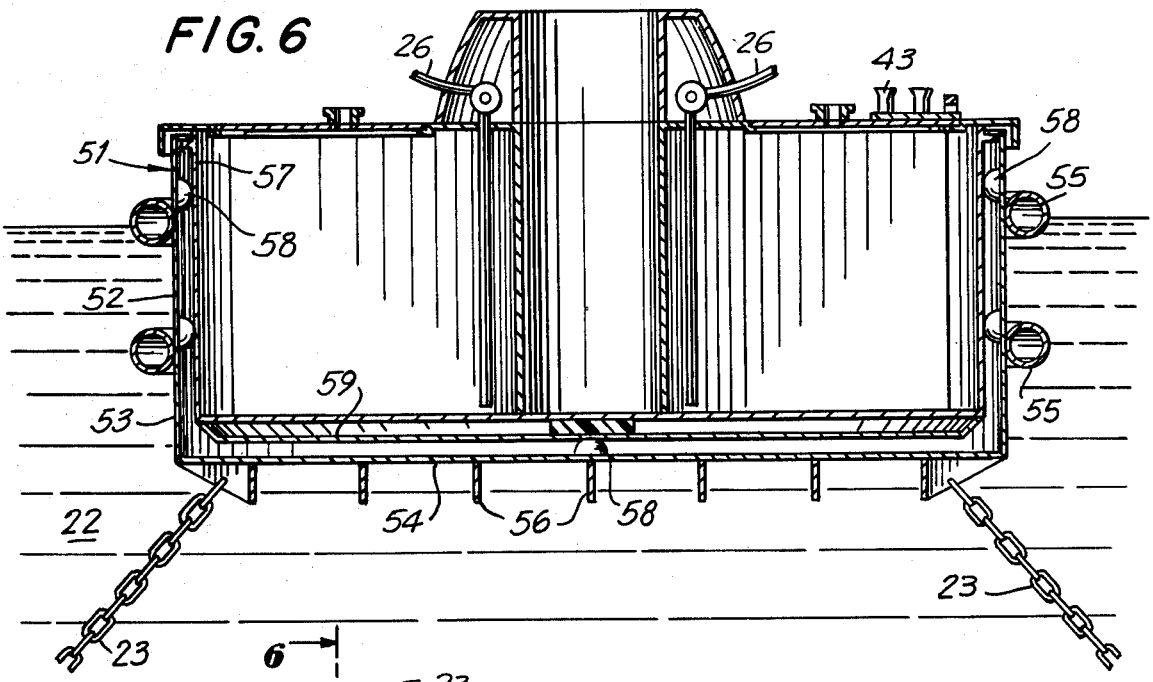
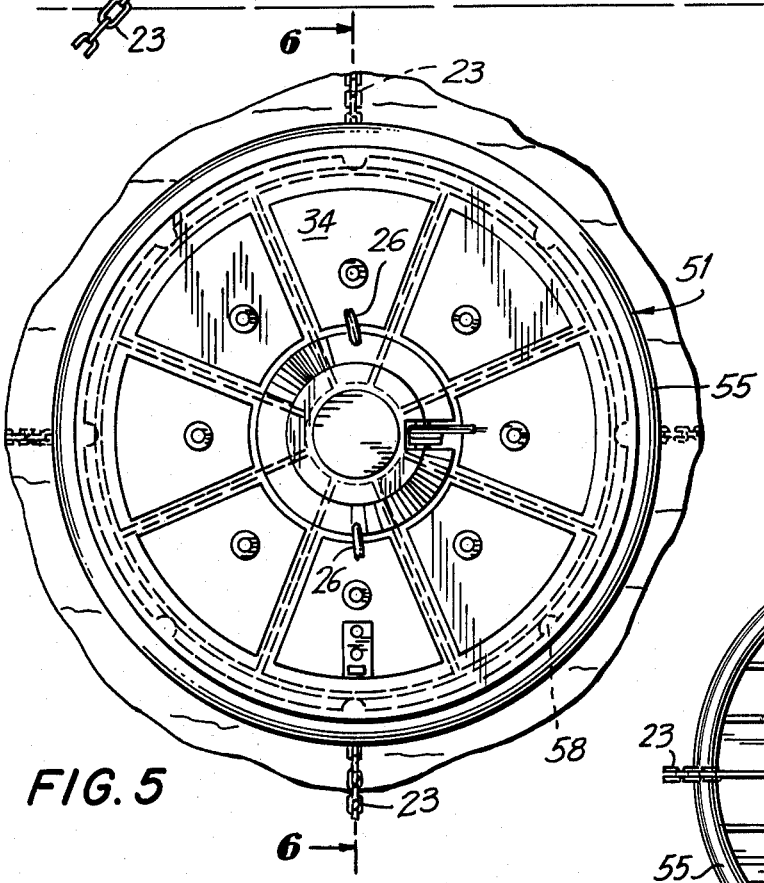
FIG. 5
FIG. 7
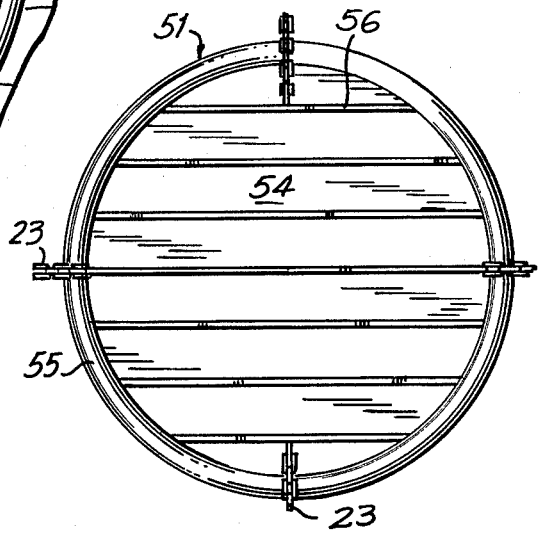

FIG. 9
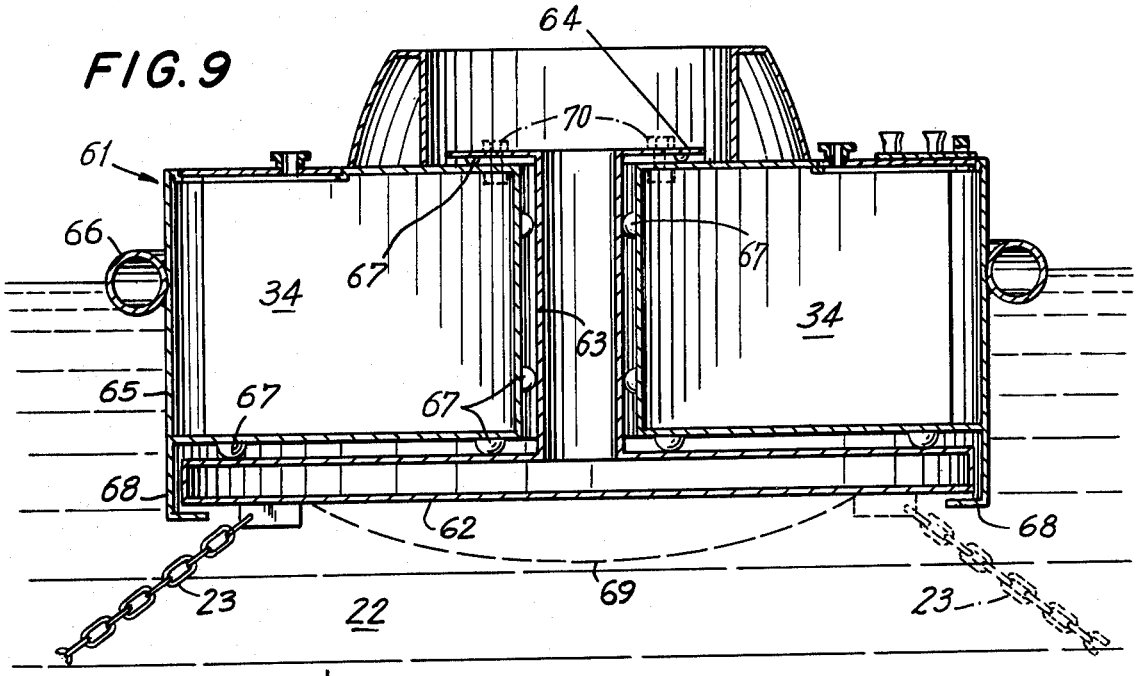
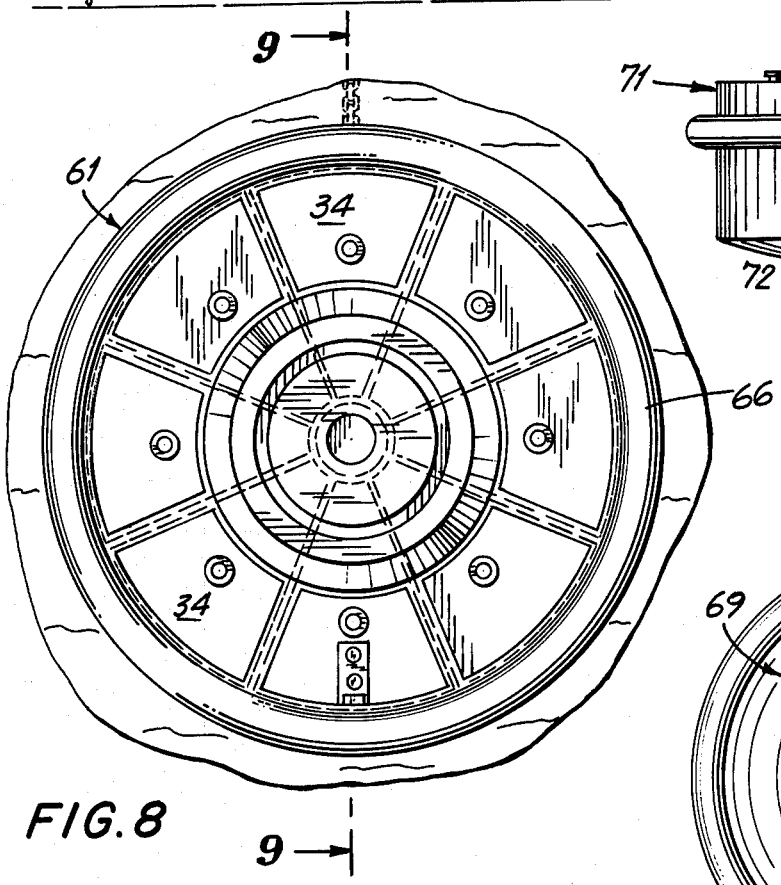
FIG. 8
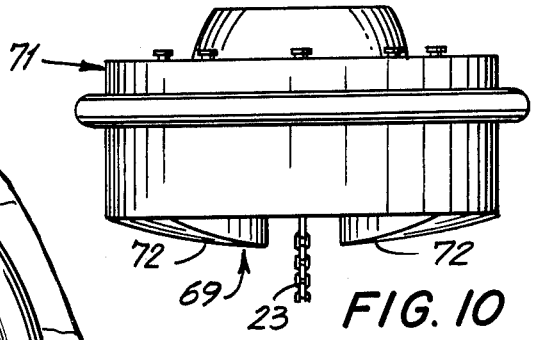
FIG. 10
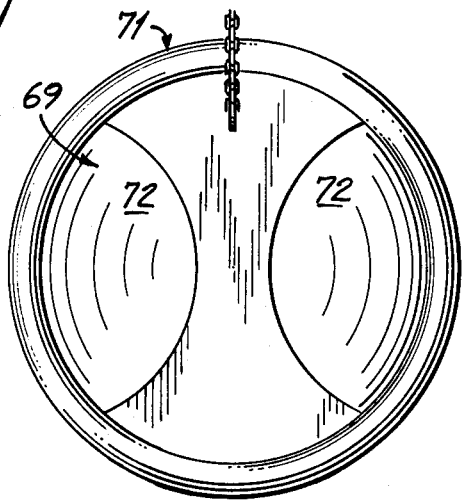
FIG. 11

SEA TERMINAL

This is a division, of application Ser. No. 730,109, filed Oct. 6, 1976 now U.S. Pat. No. 4,067,080, which is a continuation of application Ser. No. 529,651, filed Dec. 4,1974, and now abandoned.

BACKGROUND OF THE INVENTION

Floating sea terminals are known in the art and have been used to eliminate the need for deep water ports for large ships to take on and discharge cargo such as oil. An offshore floating terminal having a hose connection to the shore provides a mooring for a ship and means to connect a cargo hose from the ship to the terminal. As ships will swing due to tide and wind changes, the prior art of sea terminals has found it necessary to provide complex swivel arrangements to permit the ship to swing about the terminal without fouling the mooring lines and cargo hoses. It is also known in the art to provide drilling ships carrying drilling apparatus which may be moved into position for drilling operation. However, such drilling ships which are expensive lack versatility such as storage capability.

SUMMARY OF THE INVENTION

Generally speaking, in accordance with the invention, a sea terminal is provided having self-contained storage compartments which can rotate with respect to the portions used to anchor the sea terminal in an offshore position. A ship would be moored to the rotatable compartment structure and the cargo hoses connected between the ship and the terminal would also join to the rotatable compartment structure. In such manner, swinging of the ship would cause the compartment structure to also swing or rotate with respect to the mooring points of the terminal to thereby eliminate the possibility of fouling of the mooring lines and cargo hoses.

In another embodiment of the invention, a sea terminal is provided having self-contained drilling apparatus. The terminal also includes an oil storage compartment and all necessary supporting equipment. In order that a cargo ship can properly be moored to the sea terminal, the top platform of the terminal is preferably rotatable so as to rotate with the moored cargo ship as the ship shifts due to changes in wind and current.

Accordingly, it is an object of this invention to provide an improved sea terminal.

Another object of the invention is to provide an improved self-contained sea terminal.

A further object of the invention is to provide an improved sea terminal having storage compartment means capable of rotating or shifting with respect to a fixed anchoring point so as to avoid tangling of mooring lines and cargo hoses connected between a ship and the sea terminal.

Still another object of the invention is to provide an improved sea terminal carrying drilling apparatus and having storage compartment means for storing pumped sub-sea oil.

Another object of the invention is to provide an improved sea terminal having a rotatable portion to which a cargo ship can be moored to permit swing of the cargo ship and mooring point with respect to the terminal to avoid the possibility of line tangling, terminal damage and the like.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5 is a top plan view, partly in section, of another embodiment of the sea terminal;

FIG. 6 is a sectional view taken along line 6—6 of FIG. 5;

FIG. 7 is a bottom plan view of the sea terminal of FIG. 6;

FIG. 8 is a top plan view, partly in section, of a further embodiment of the sea terminal;

FIG. 9 is a sectional view taken along line 9—9 of FIG. 8;

FIG. 10 is an end elevational view of a sea terminal showing an embodiment of a keel structure;

FIG. 11 is a bottom plan view of the sea terminal of FIG. 10;

DESCRIPTION OF THE PREFERRED EMBODIMENTS

Figure 1:
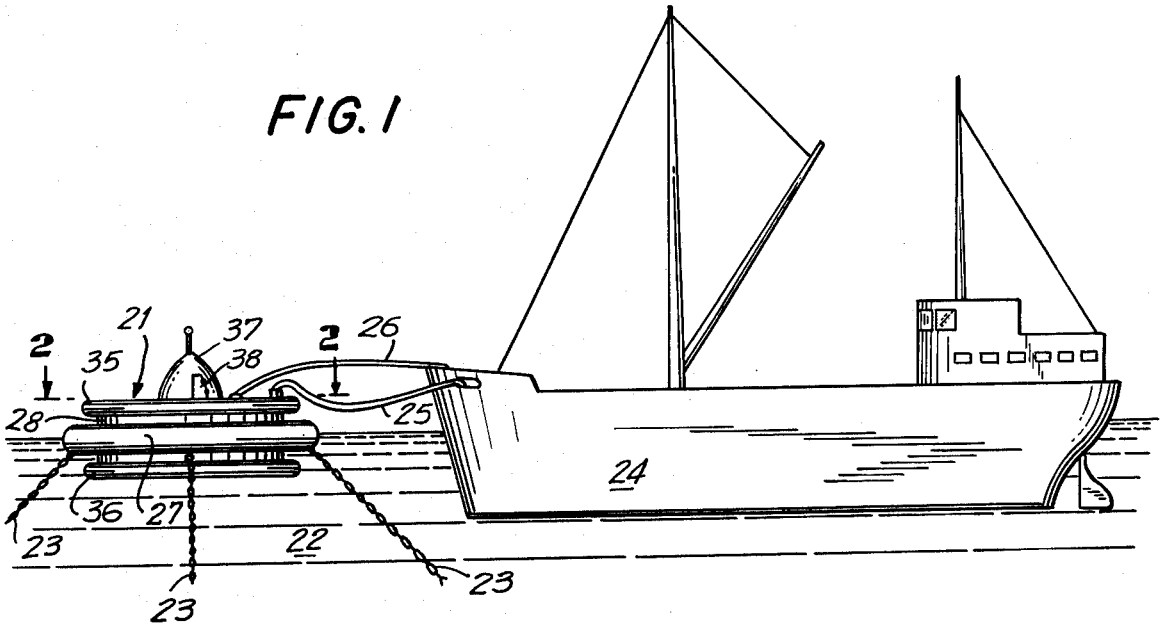
FIG. 1 is an elevational view of a sea terminal constructed in accordance with the instant invention having a ship moored thereto for transfer of fluids between the ship and the terminal.

Referring now to FIGS. 1 through 4, a sea terminal indicated generally at 21 floats in an offshore body of water 22 and is anchored by means such as chains 23, lines, pilings, legs, etc. A ship 24 is shown as being moored to the sea terminal by means of a mooring line 25. A cargo hose 26 connects between the ship 24 and sea terminal 21 for transfer of cargo such as oil between the sea terminal and the ship.

Figure 2:
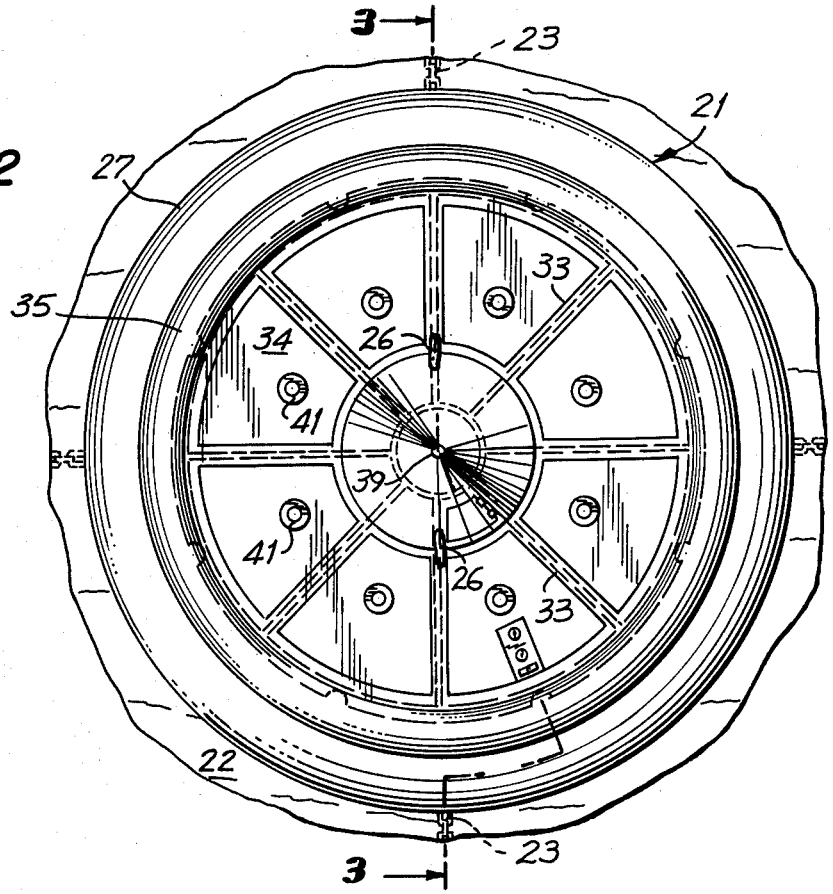
FIG. 2 is a top plan view, partly in sections, of the sea terminal of FIG. 1.
Figure 4:
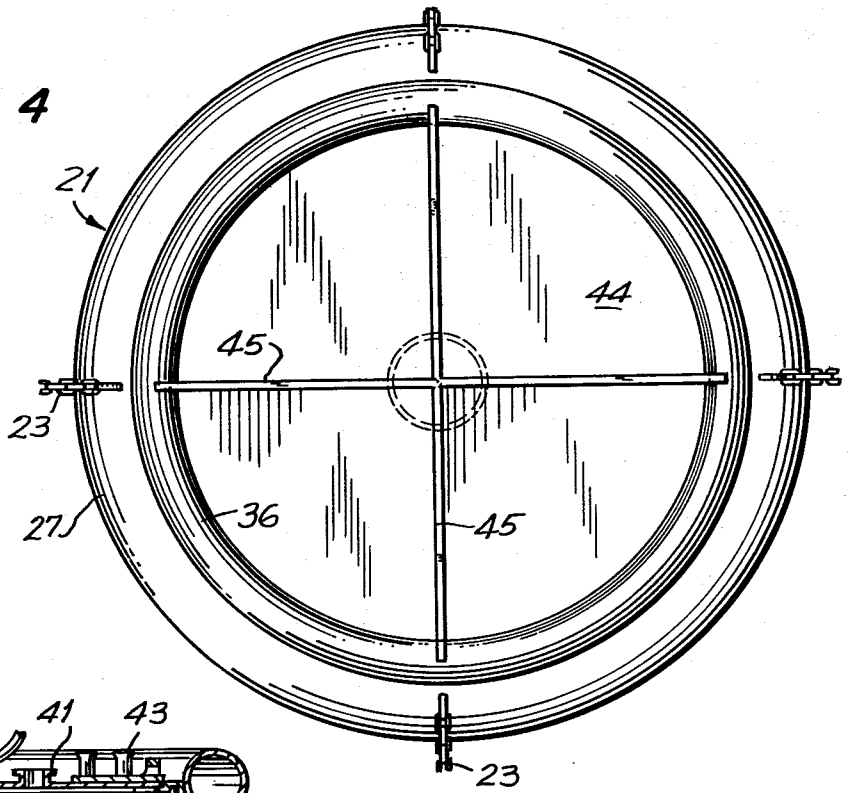
FIG. 4 is a bottom plan view of the sea terminal of FIG. 1.
Figure 3:
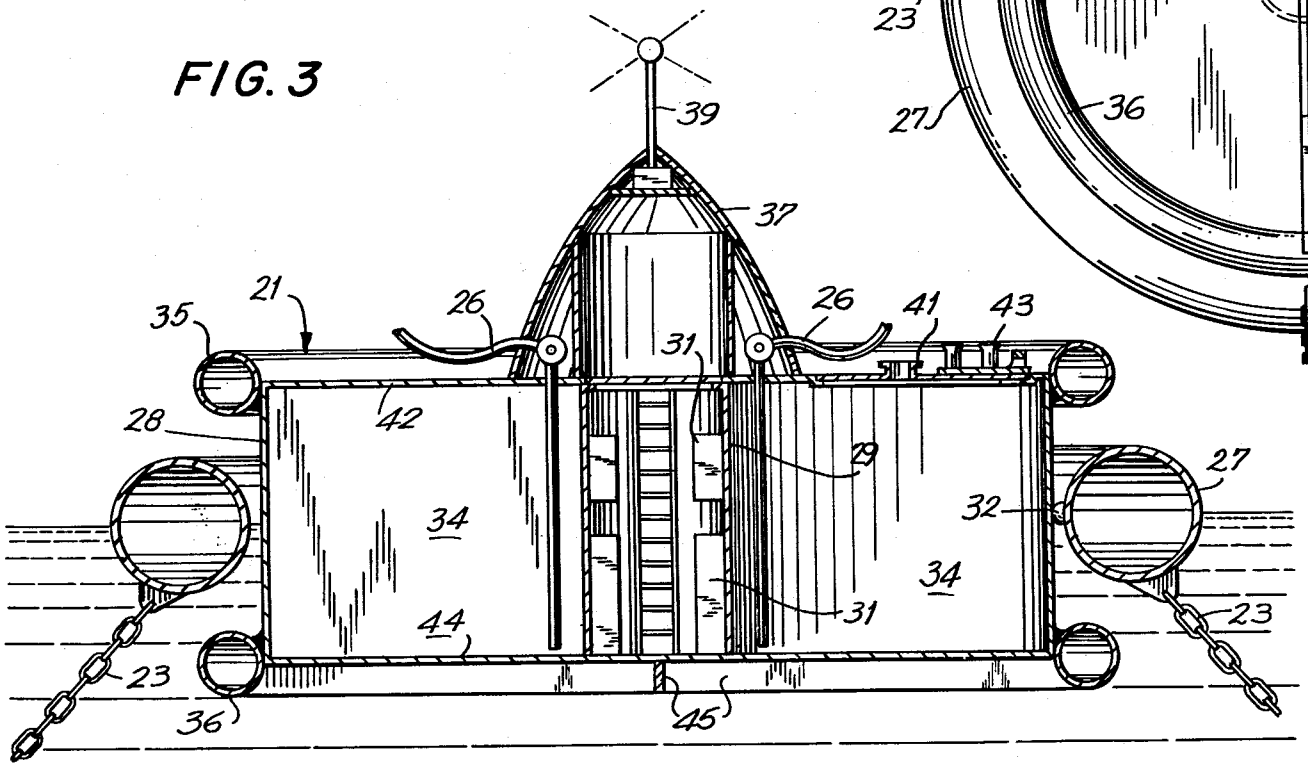
FIG. 3 is a sectional view taken along line 3—3 of FIG. 2.

Referring more particularly to FIGS. 2 through 4, a hollow, buoyant floatation ring 27 surrounds the sea terminal and has the anchor chains 23 connected thereto. Floatation ring 27 may also act as a fender to prevent damage to the sea terminal by ship 24.

A housing 28 forms the main body of the sea terminal. A central compartment 29 extends centrally within housing 28 and provides a compartment for the pumps, generators and other operative equipment indicated generally at 31. Central compartment 29 isolates equipment 31 from the storage compartment located between the exterior wall of central compartment 29 and the interior wall of housing 28. Floatation ring 27 carries projections 32 of suitable material such as neoprene to provide bearing surfaces whereby housing 28 is freely rotatable within floatation ring 27.

A plurality of radial walls 33 extend between central compartment 29 and housing 28 to divide the sea terminal into a plurality of storage compartments 34. An upper collar 35 is secured to housing 28 at the upper edge thereof and a lower collar 36 is secured to housing 28 at the lower edge thereof. Collars 35 and 36 act as bumpers or fenders to protect the sea terminal. It will be also understood that housing 28 which floats in the body of water will float at different levels depending on the storage state of storage compartments 34. Collars 35 and 36 act as stops in cooperation with floatation ring 27 to thereby limit the relative movement of housing 28 with respect to floatation ring 27. Collars 35 and 36, being preferably hollow, can also provide buoyancy to the sea terminal, should the sea terminal be heavily loaded or encounter heavy seas.

A roof 37 overfits housing 28. Entry is gained thereinto by means of an access door 38. Roof 37 defines a room in which a worker can store tools, effect repairs and gain protection from the elements. A beacon 39 provides a visual marker for location of the sea terminal. Beacon 39 would also include a radar reflector.

Each storage compartment 34 has access thereto through a port 41 and/or a cargo hose 26. The top wall 42 of housing 28 also has mooring bits 43 secured thereto by which a ship can be moored to the sea terminal.

Housing 28 is also provided with a bottom wall 44 to which is secured keel plates 45 which act to slow rotation of the housing 28.

In operation, a ship would secure its mooring line to bits 43 and cargo hoses would be connected between the ship and storage compartments 34 to pump cargo from ship to the storage compartments or from the storage compartments to the ship. Floatation ring 27 is anchored in a relatively fixed position through chains 23 and anchors (not shown). If the position of the ship should change as a result of changes in wind direction, tide or current, the ship will swing and cause rotational movement of housing 28 as a result of connection of mooring line 25 to mooring bits 43. Since the entire housing 28 will rotate, there can be no possible tangling of the mooring lines and cargo hoses. Keel plates 45 provide a drag force on housing 28 against rotation so as to slow the rotational movement of the housing under the force applied by the moving ship.

It should be noted that when filling or emptying storage compartments 34, it is preferred that diametrically opposed storage compartments be concurrently emptied or filled in order to maintain the balance of housing 28 and limit the possibility of tilting or tipping thereof.

An alternate embodiment of sea terminals is shown in FIGS. 5 through 7. Sea terminal 51 has an outer shell 52 formed of annular outer wall 53 and a bottom wall 54. Floatation fenders 55 surround outer wall 53 and the position of sea terminal 51 in a body of water 22 is fixed through chains 23 and anchors (not shown). If desired to anchor sea terminal 51 at a single point, it is desirable that keel plates 56 extend from bottom wall 54 to provide a damping action against movement of outer shell 52. A housing 57 is located within outer shell 52. Housing 57 is also divided into the storage compartments 34, is provided with mooring bits 43 and otherwise acts to store, receive and discharge cargo in the same manner as sea terminal 21. Bearings 58 are secured to the inside wall of outer wall 53 and act against the outside wall of housing 57 to permit rotation of housing 57 within outer shell 52. A bearing 58 is also carried by bottom wall 54 to aid in supporting housing 57 within outer shell 52. The space between housing 57 and outer shell 52 may preferably be filled with a fluid material which may also be buoyant and one or more keel plates 59 may be carried by the bottom wall of housing 57 to provide a damping action as housing 57 swings or rotates within outer shell 52.

As aforenoted, a principal object of the present invention is to provide a sea terminal which does not require complex swivel connections through which cargo is transferred. In the embodiments heretofore described, the housing defining the cargo compartments can rotate with respect to the means for anchoring the housing in a fixed position. The embodiment of FIGS. 8 and 9 can provide for either a fixed mooring or a mooring which will permit the entire sea terminal to move in relation to a single point mooring. Sea terminal 61 shown in FIGS. 8 and 9 has a hollow base member 62 with a tubular member 63 extending upwardly from base member 62 centrally thereof. A plate 64 is fixed to the top of tubular member 63 and extends outwardly therefrom. A housing 65 surrounds tubular member 63 and is provided with storage compartments 34 similar to those previously described. A floatation fender 66 surrounds housing 65. Bearing means 67 are carried by housing 65 and plate 64 to permit relative rotation between housing 65 and the assembly defined by base member 62, tubular member 63 and plate 64. A lip 68 carried by housing 65 overlies the edge of base member 62 to maintain within limits the relative vertical movement between housing 65 and the base member assembly.

Since housing 65 can rotate with respect to the base member assembly, sea terminal 61 can be anchored by means of chains 23 and anchors (not shown). The right hand chain 23 is shown in FIG. 9 in phantom to demonstrate that sea terminal 61 can be anchored by means of a single chain which will thereby allow movement of the entire sea terminal. If a single point anchoring is provided, it is desired that the sea terminal be provided with a keel indicated in phantom in FIG. 9. A preferred form of keel will be described in connection with FIGS. 10 and 11.

For certain applications it may be desirable to eliminate rotation between the cargo storage unit and the anchoring member. In the embodiment of FIG. 9, this could be accomplished by securing bolts 70 through plate 64 and the top wall of housing 65.

Referring now to FIGS. 10 and 11, a sea terminal 71 is shown which may be of the construction of FIGS. 8 and 9 or which may be of unitary construction and provide for no relative movement between the compartment defining housing and anchoring structure. Such a terminal would be anchored only by means of a single chain 23 and the keel 69 would be in the form of two curved keel members 72 (FIG. 11) which are closely spaced at the radial center of the structure and are widely spaced at the edges of the structure. By utilizing such a keel, allowance for tidal flow through the keel will provide guiding forces to stablize the position of sea terminal 71 when the sea terminal is not otherwise being acted on by forces applied thereto as the result of a ship being moored to the sea terminal. The keel structure will also provide means for stablizing the direction of movement of the sea terminal in the event that the sea terminal is to be towed or self-propelled to a different location.

While a single point anchored sea terminal will obviously not remain as stationary as a sea terminal anchored by two or more anchors, the single point anchoring is also effective to eliminate the possibility of tangling of cargo hoses and mooring lines when a vessle moored thereto changes positions in response to changes in wind direction, currents and tides.

While several embodiments of sea terminals have thus far been shown, such embodiments are representative only. The concept is that sea terminals could be capable of moving as a result of movement of a ship moored thereto to eliminate the need for complex rotatable cargo passing apparatus. The sea terminal of the present invention can be extremely large to store vast quantities of cargo. The terminal can be self-powered and can also be self-propelled, if desired. The terminals can also be self-positioning utilizing known electronic devices.

Small sea terminals could also be utilized such as by marinas to dispense gasoline and other products to pleasure boats. The sea terminal could be located as convenient without requiring the construction of floating docks near the shore line and the dredging that usually accompanies same.

Figure 13:
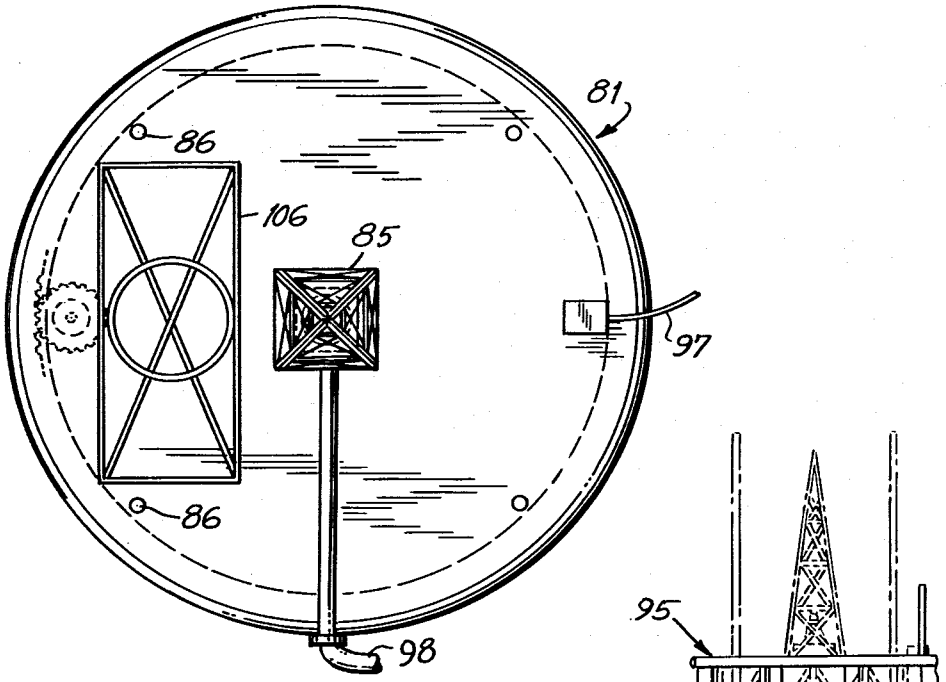
FIG. 13 is a top plan view of the sea terminal of FIG. 12.
Figure 12:
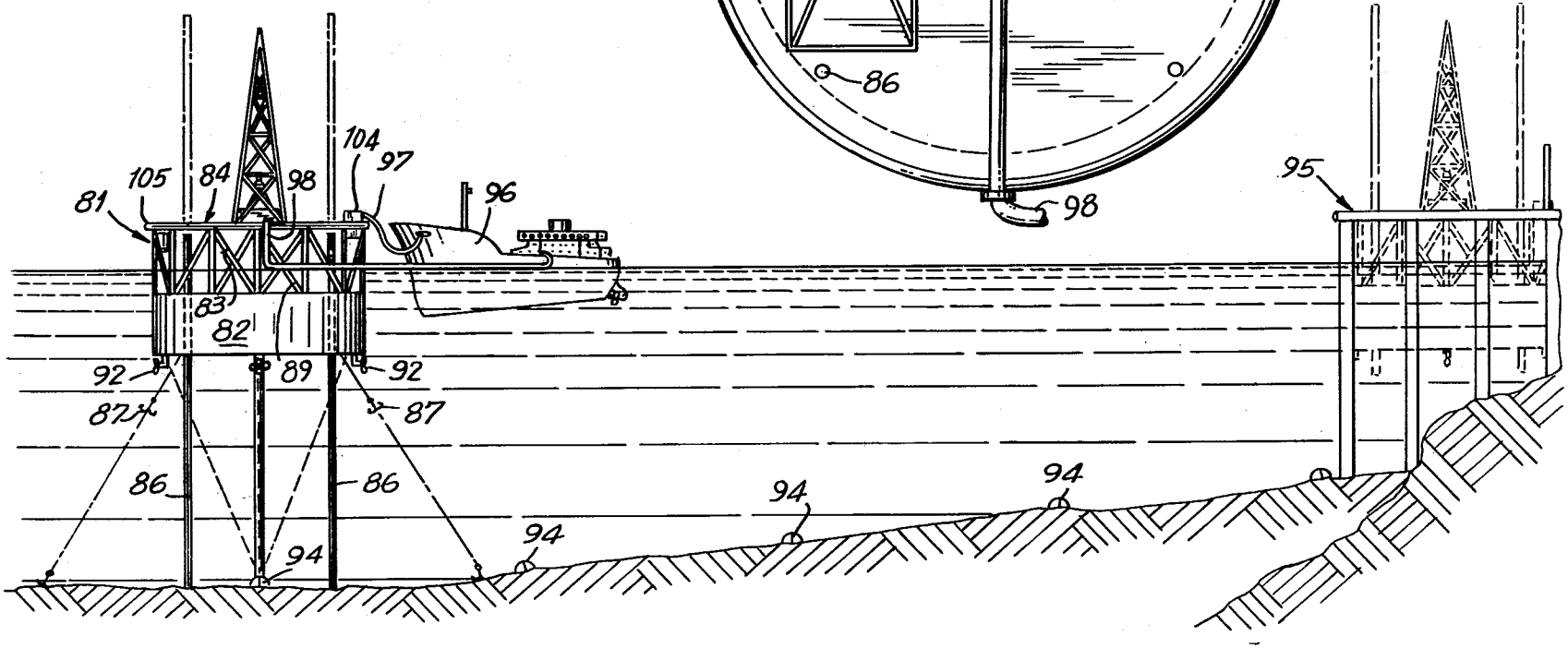
FIG. 12 is an elevational, schematic view of a further embodiment of a sea terminal in an offshore position with the sea terminal being shown in phantom in a berth.
Figure 14:
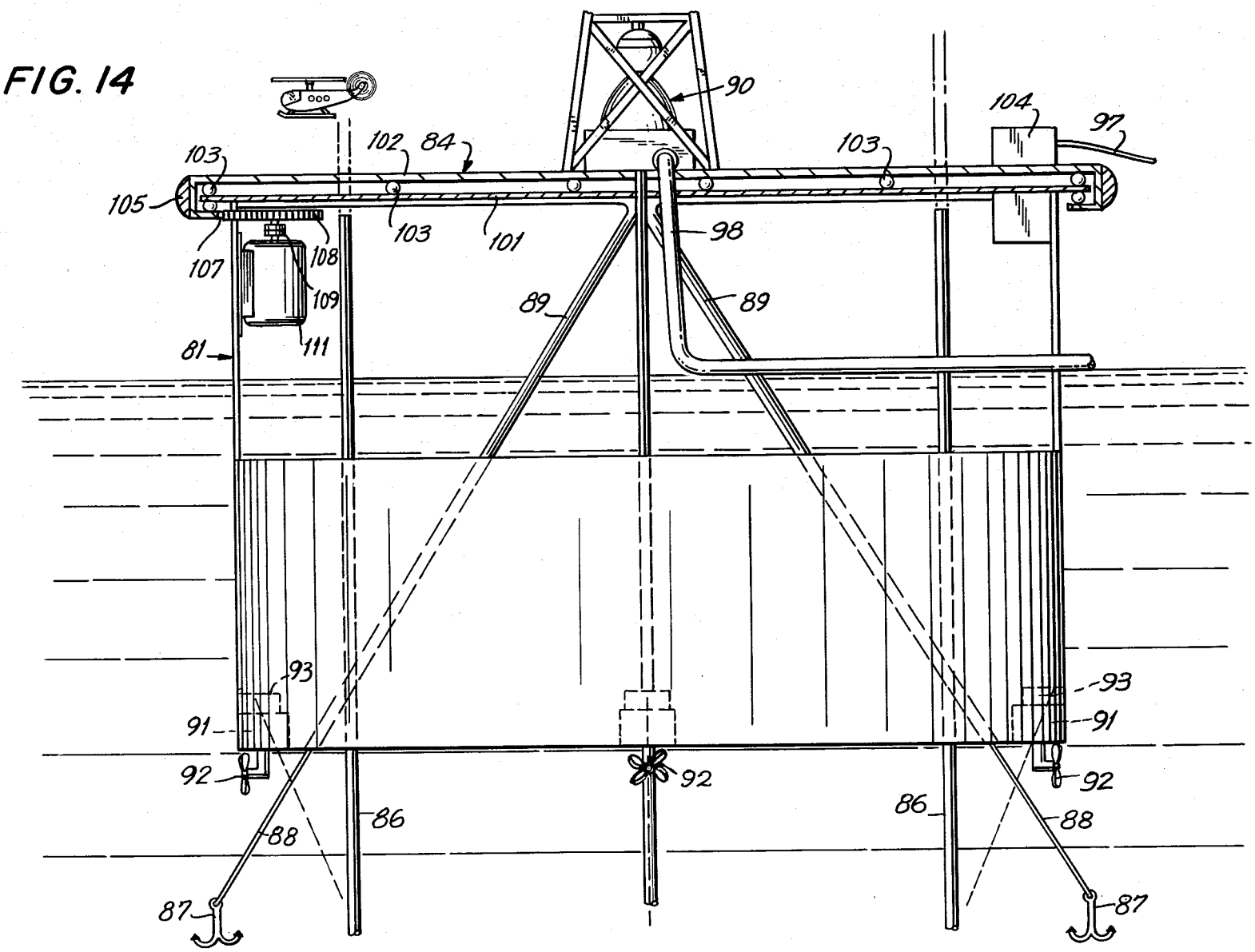
FIG. 14 is an enlarged elevational view of the sea terminal of FIG. 12.

Referring now to FIGS. 12 through 14, a self-contained sea terminal is indicated generally at 81. Such sea terminal is designed to be completely self-contained and self-powered. Sea terminal 81 has a cargo compartment 82 from which extends a plurality of hollow struts 83 which support a platform generally indicated at 84. Platform 84 carries oil drilling apparatus 85 whereby a sub-sea well may be drilled by the sea terminal. The sea terminal also carries motors, generators, pumps and all means of support equipment necessary for drilling, pumping and otherwise powering the sea terminal.

Sea terminal 81 can be positioned utilizing a wide variety of means. Legs 86 are shown in an extended position where the sea terminal is located in sufficiently shallow water so that the legs may make contact with the ocean bed. Legs 86 may be raised for moving the terminal or if the legs are not to be used and a raised position of legs is shown in phantom lines in FIGS. 12 and 14.

If the sea terminal 81 is to be moored in deep water making use of legs 86 impracticable, the sea terminal may be anchored by means of suitable anchors 87 carried at the ends of anchor lines 88 which pass through hawse pipes 89.

Alternatively, the sea terminal may carry a plurality of drive motors or engines 91 which operate propellors 92 which respond to electronic devices known as hydrophones 93 to maintain the sea terminal in a preselected position with respect to a beacon 94 lying on the ocean bed. As hydrophone technology is known, no further description thereof is deemed necessary. It is sufficient to note that engines 91 will selectively drive and position propellors 92 to maintain the sea terminal in the proper position with respect to a beacon 94 without otherwise physically anchoring the sea terminal.

Sea terminal 81 after drilling a well can pump oil from the well into cargo compartment 82. If desired, sea terminal 81 can be self-propelled to a discharge location such as a port generally indicated at 95 through use of drive motors 91. The sea terminal can automatically be driven between an offshore location and port 95 by appropriate computer control of drive motors 91 in response to hydrophones 93 following a plurality of beacons 94 positioned on the ocean floor. The drive shafts for propellors 92 could be rotated so that all propellors drive in the same direction for navigation of the sea terminal. Also, sea terminal 81 could be navigated by suitable navigation control operated from bridge 90.

Alternatively, it may be desired to pump the oil from cargo compartment 82 into a cargo ship 96. The cargo ship would be moored to the sea terminal by means of a mooring line 97 with oil discharge taking place through a cargo line 98.

As previously discussed in connection with other embodiments of the instant invention, a cargo ship moored to a sea terminal will normally swing due to wind and tide changes. To avoid tangling of mooring and cargo lines and to avoid the possibility of the ship striking and damaging the sea terminal, it is desirable that the cargo ship be freely swingable with respect to fixed portions of the sea terminal.

In the embodiment of FIGS. 12 through 14, the platform generally indicated at 84 is preferably constructed with a lower fixed platform 101 and an upper rotatable platform 102 capable of freely rotating about the lower platform on bearings 103. Mooring line 97 is connected to a mooring box 104 carried by upper rotatable platform 102 whereby a pull on mooring line 97 as a result of a change in position of the cargo ship will tend to cause rotation of upper rotatable platform 102. Upper rotatable platform 102 is provided with a fender 105.

In view of the large size and weight of the upper rotatable platform (it may, for example, have a helicopter landing pad 106,) it is desirable that the upper rotatable platform 102 be driven in response to movement of cargo ship 96. To this end, an inner edge of upper rotatable platform 102 is formed as a sun gear 107 which is engaged by a drive gear 108 driven through a clutch 109 by a motor 111. Mooring box 104 carries electronic sensing gear which senses lateral pulls on mooring line 97 as the cargo ship shifts. Through suitable electronic circuitry (not shown) a lateral angular pull on mooring line 97 will cause motor 111 to rotate in the appropriate direction to rotate upper rotatable platform 102 in an anticipatory direction. Cargo line 98 would be connected to the pumps through a suitable swivel connection (not shown) so as to avoid any tangling of the mooring line with the cargo lines as the cargo ship shifts and upper rotatable platform 102 rotates in response thereto.

It may be understood from the foregoing description that sea terminal 81 is a self-contained unit of massive size. It may be provided with living and working quarters, navigational equipment and the other equipment and machinery to accomplish the multitude of purposes and uses for which the sea terminal is designed.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A self-contained terminal for the storage of products at sea and for the transference of products between a cargo vessel and said terminal comprising a first structure, positioning means carried by said first structure for maintaining said terminal at a preselected location, a second structure having a generally cylindrical configuration formed with an outer side wall, a top wall, a bottom wall and a cylindrical inner wall about a central vertical axis, said first structure including a base member and a central member extending from the center of said base member within said second structure along said vertical axis, said second structure being rotatable about said central member, means mounting said second structure in rotatable relationship about said central member with respect to said first structure for maintaining said second structure in said preselected location while permitting relative rotational movement between said second and said first structures, and limiting means for limiting the vertical movement between said first and second structure, said second structure including at least one product storage container, mooring means carried by said second structure and positioned eccentrically with respect to said central member for mooring a vessel to said terminal, and at least one product transfer means carried by said second structure independently of said mooring means and positioned eccentrically with respect to said central member for the transfer therethrough of product between said product storage container and the vessel.

2. A self-contained terminal as claimed in claim 1, wherein said outer wall of said second structure extends downwardly beyond said base member of said first structure and includes an inwardly facing peripheral lip overlapping at least a portion of the bottom of said base member of said first structure to form said limiting means.

3. A self-contained terminal as claimed in claim 2, wherein said central member includes a plate positioned at the top of said central member extending over at least a portion of said top wall of said second structure.

4. A self-contained terminal as claimed in claim 3, wherein said plate includes means to eliminate rotation between said second structure and said first structure.

5. A self-contained terminal as claimed in claim 4, wherein said means mounting said first structure in rotatable relationship with respect to said second structure includes bearing means acting between said bottom wall of said second structure and said base member of said first structure and between said inner wall of said second structure and said central member of said first structure.

6. A self-contained terminal as claimed in claim 5, wherein said second structure includes a ring surrounding said outer side wall.

7. A self-contained terminal as claimed in claim 6, wherein said base member of said first structure includes a keel.

* * * * *